US008594548B2

(12) United States Patent
Takeshita et al.

(10) Patent No.: US 8,594,548 B2
(45) Date of Patent: Nov. 26, 2013

(54) IMAGE FORMING APPARATUS

(75) Inventors: Masami Takeshita, Ibaraki (JP); Masahiro Yamazaki, Ibaraki (JP); Mamoru Takayama, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 272 days.

(21) Appl. No.: 12/929,919

(22) Filed: Feb. 24, 2011

(65) Prior Publication Data

US 2011/0211875 A1 Sep. 1, 2011

(30) Foreign Application Priority Data

Feb. 26, 2010 (JP) ..... 2010-041953

(51) Int. Cl.
*G03G 15/20* (2006.01)

(52) U.S. Cl.
USPC ..... 399/323; 399/328; 399/67; 399/69

(58) Field of Classification Search
USPC ..... 399/323, 328, 67, 69
See application file for complete search history.

(56) References Cited

U.S. PATENT DOCUMENTS

| | | | | |
|---|---|---|---|---|
| 5,157,449 | A | 10/1992 | Matsuno et al. | |
| 5,406,363 | A * | 4/1995 | Siegel et al. | 399/323 |
| 5,764,269 | A | 6/1998 | Takeshita et al. | |
| 6,539,195 | B2 | 3/2003 | Sakaba et al. | |
| 2006/0182456 | A1 * | 8/2006 | Naoi et al. | 399/50 |
| 2008/0056761 | A1 | 3/2008 | Kawahara et al. | |
| 2009/0123185 | A1 * | 5/2009 | Lin et al. | 399/176 |
| 2009/0190941 | A1 | 7/2009 | Hashimoto et al. | |
| 2009/0304419 | A1 * | 12/2009 | Roof et al. | 399/323 |

FOREIGN PATENT DOCUMENTS

| | | | |
|---|---|---|---|
| JP | 09-006122 | | 1/1977 |
| JP | 03-081791 | A | 4/1991 |
| JP | 08-262916 | | 10/1996 |
| JP | 2003302859 | A | 10/2003 |
| JP | 2005128333 | A | 5/2005 |
| JP | 2007-199462 | | 8/2007 |
| JP | 2007233228 | A | 9/2007 |
| JP | 2008-003277 | | 1/2008 |
| JP | 2009300704 | A | 12/2009 |

OTHER PUBLICATIONS

Japanese Office Action for counterpart Japanese Application No. 2010-041953 dated Aug. 27, 2013.

* cited by examiner

*Primary Examiner* — Walter L Lindsay, Jr.
*Assistant Examiner* — Roy Y Yi
(74) *Attorney, Agent, or Firm* — Harness, Dickey & Pierce, P.L.C.

(57) ABSTRACT

An image forming apparatus is disclosed that includes a fixing device including: a fixing member; and a pressure member configured to be pressed against the fixing member in order to form a nip portion, wherein a sheet configured to be fed into the nip portion in order to fix unfixed toner image thereon; a compressor configured to supply compressed air; a nozzle configured to be disposed at an outlet side of the nip portion and to blast the compressed air to an adhered portion of the sheet to the fixing member; and a controller configured to correct open-time of the nozzle based on image forming condition and to control number of times that the compressed air is blasted to the sheet in accordance with length of corrected open-time, wherein the open-time of the nozzle is determined in accordance with basis weight of the sheet.

21 Claims, 10 Drawing Sheets

FIG.4

| BASIS WEIGHT | 35～64g/m$^2$ | 65～85g/m$^2$ | 86～156g/m$^2$ | 157～g/m$^2$ |
|---|---|---|---|---|
| OPEN-TIME T0 | 90ms | 75ms | 60ms | 0ms |
| CORRECTION VALUE | PROCEED TO FIG.5 | | 0ms | |

FIG.5

| PRINT AREA RATIO | 0～15% | 15～50% | 50～100% |
|---|---|---|---|
| CORRECTION VALUE | 0ms | +10ms & PROCEED TO FIG.6 | +20ms & PROCEED TO FIG.6 |

FIG.6

| PRINT DENSITY | THIN (−0.10 OD) | NORMAL | THICK (+0.10 OD) |
|---|---|---|---|
| CORRECTION VALUE | 0ms | PROCEED TO FIG.7 | +10ms & PROCEED TO FIG.7 |

FIG.7

| NUMBER OF PAGES | 0～50 KILO PAGES | 50～800 KILO PAGES |
|---|---|---|
| CORRECTION VALUE | +10ms & PROCEED TO FIG.8 | PROCEED TO FIG.8 |

FIG.8

| NUMBER OF PAGES | 0～50 KILO PAGES | 50～450 KILO PAGES |
|---|---|---|
| CORRECTION VALUE | +10ms & PROCEED TO FIG.9 | PROCEED TO FIG.9 |

FIG.9

| HUMIDITY | 0～50% | 50～100% |
|---|---|---|
| CORRECTION VALUE | PROCEED TO FIG.10 | +5ms & PROCEED TO FIG.10 |

FIG.10

| TEMPERATURE | 0～25℃ | 25～36℃ |
|---|---|---|
| CORRECTION VALUE | PROCEED TO FIG.11 | +5ms & PROCEED TO FIG.11 |

FIG.11

| FIXING PRESET TEMPERATURE | LOWER (−10℃) | NORMAL | HIGHER (+10℃) |
|---|---|---|---|
| CORRECTION VALUE | +10ms & PROCEED TO FIG.12 | PROCEED TO FIG.12 | −10ms & PROCEED TO FIG.12 |

FIG.12

| FEEDING SPEED | NORMAL | SLOWER (−2ips) |
|---|---|---|
| CORRECTION VALUE | 0ms | +10ms |

FIG.13

| AMOUNT OF TONER ON DUMMY IMAGE | THIN (1.10～1.20 OD) | NORMAL (1.20～1.30 OD) | THICKISH (1.30～1.40 OD) | THICK (1.40～1.50 OD) |
|---|---|---|---|---|
| CORRECTION VALUE | −10ms | 0ms | +20ms | +40ms |

FIG.14

| AMOUNT OF TONER CONSUMED IN DEVELOPING DEVICE | 0～4g/min | 4～15g/min | 15～g/min |
|---|---|---|---|
| OPEN-TIME T0 | 70ms | 90ms | 110ms |

IMAGE FORMING APPARATUS

BACKGROUND OF THE INVENTION

1. Field of the Invention

The present invention generally relates to an image forming apparatus which includes a fixing apparatus that fixes an unfixed toner image onto a recording material.

2. Description of the Related Art

Conventionally, a heat fixing apparatus which includes a fixing member, such as a fixing roller, that is heated by a heater and a pressure member, such as a pressure roller, that is pressed against the fixing member has been known and widely adopted into an image forming apparatus. The heat fixing apparatus nips and conveys a recording medium such as a paper or the like (hereinafter referred to as a sheet) that carries an unfixed toner image at a nip portion formed between the fixing member and the pressure member, and fixes a toner image onto the sheet by heat and pressure.

Further, a fixing apparatus which utilizes an endless belt as a fixing member has been known. According to the fixing apparatus, it becomes possible to shorten a warming-up time and to achieve energy-saving, since the thermal capacity of the endless belt is relatively small.

FIG. 1 shows a side view of an example of a conventional heat fixing apparatus. A sheet S on which a toner image 105 is transferred is fed into a fixing apparatus 110. The toner image which is transferred onto the sheet S is fixed by heat and pressure at a nip portion N where a fixing roller 111 and a pressure roller 112 nip the sheet S therebetween.

A problem in that the sheet S is wrapped tightly around the fixing roller 111 and is not conveyed properly after passing through the nip portion N may occur. Thus, a technique that strips the sheet S from the fixing roller 111 by pressing a scraper 108 or the like onto the fixing roller 111 has been widely known. However, a problem in that the surface of the fixing roller 111 is attrited by being pressed by the roller 111 and thereby a printed image is defected, and a problem in that contamination such as toner is accumulated onto the scraper 108 and thereby the sheet S is spotted have been known.

A technique which solves the problems described above has been proposed by for example Japanese Patent Laid-Open Publication No. H03-081791 (patent document 1). According to the technique, the sheet is stripped from the fixing roller by blasting compressed air to the fore-end of the sheet. Patent document 1 discloses a sheet stripping apparatus which strips an electrophotographic print sheet from a fixing roller by blasting compressed air when the sheet is adhered to the fixing roller in a fixing procedure of the sheet. The sheet stripping apparatus includes an air pressure controller which controls air pressure of the compressed air according to the thickness of the sheet so that the sheet is stripped from the fixing roller.

Herein, blasting time of the compressed air which is required for stripping the sheet depends on feeding speed of the sheet, capacity of an air tank, an opening space of an exhaust nozzle of the compressed air, number of the exhaust nozzle or the like. For example, Japanese Patent Laid-Open Publication No. 2007-233228 (patent document 2) discloses that the blasting time of the compressed air is preferably set from 30 ms to 200 ms, and once is preferable number of times that the compressed air is blasted to the fore-end of the sheet. Patent document 2 discloses a fixing apparatus which includes an air blasting device that blasts air from downstream side of a nip portion to neighborhood of the nip portion. The air blasting device includes a first air blasting member which blasts air to the neighborhood of the nip portion and strips a recording medium from a heater, a second air blasting member which blasts air to a fixed recording medium and cools down the fixed recording medium, a selecting means for selecting the first air blasting member or the second air blasting member that blasts air, and an air guide member which is disposed in downstream side of the recording medium in the direction of a feeding path and guides the air blasted from the second air blasting member to a peripheral surface of a pressure welding member in order to cool down the pressure welding member.

Because of recent demands for a variety of electrophotographic devices, basis weight of the sheet ranges from 35 $g/m^2$ to 199 $g/m^2$. The blasting time or the air pressure that makes it possible to strip the sheet from the fixing roller or the like varies depending on the basis weight or thickness of the sheet.

For example, in a condition where feeding speed of the sheet is 700 mm/s, capacity of an air tank is 1300 ml, pressure of compressed air is 0.1 MPa, an opening space of an exhaust nozzle of the compressed air is 3 $mm^2$, number of the exhaust nozzle is one, and printing speed is 150 sheets per minute, the blasting time that makes it possible to strip the sheet, which has basis weight of 75 $g/m^2$, from the fixing roller or the like is empirically determined to 90 ms. The sheet which has basis weight of 75 $g/m^2$ is most sought after.

However, in a case where amount of toner which is transferred onto the sheet is increased by variation in condition or environmental factors of the electrophotographic device, it becomes difficult to strip the sheet from the fixing roller, since adhesion of the sheet which is wrapped around the fixing roller becomes larger. Thus, a problem in that the electrophotographic device is shut down because of a sheet jam may occur.

This problem occurs in a case where a light weight sheet of which basis weight ranges from 35 $g/m^2$ to 85 $g/m^2$ is used, and notably occurs in a case where the basis weight of the sheet ranges from 35 $g/m^2$ to 64 $g/m^2$. Herein, as the basis weight of the sheet decreases, rigidity of the sheet decreases. As the amount of toner which is transferred onto the sheet increases, adhesion of the sheet to the fixing roller increases. Insufficient rigidity of the light weight sheet and increased adhesion of the sheet cause decrease of stability in stripping the sheet from the fixing roller. Thus, the problem is caused by the decrease of stability in stripping the sheet from the fixing roller. Even when the fore-end of the sheet is stripped from the fixing roller, a middle portion of the sheet may be adhered to the fixing roller and may cause middle portion jam because of the increased adhesion and the insufficient rigidity of the sheet.

For example, Japanese Patent Laid-Open Publication No. 2005-128333 (patent document 3) discloses a technique for controlling blast rate or blast pressure of compressed air according to image information. Patent document 3 discloses an image forming apparatus which includes a toner image forming means for forming unfixed toner image, a fixing means which includes a heat roller and a pressure roller, and a strip guide plate of which a side is disposed adjacent to the surface of the heat roller, and gas blasting device which blasts pulsed compressed gas to a portion between the surface of the heat roller and the surface of the strip guide plate. The image forming apparatus further includes a strip means for stripping a recording medium from the heat roller and a blast controller for controlling an operating condition of the gas blasting device according to the image information and/or information about the recording medium.

The technique disclosed in patent document 3 detects a planar dimension of an area on which the toner is transferred, and strips the sheet by controlling the blast rate or the blast pressure so that the blast rate or the blast pressure meets the planar dimension of the area. It becomes possible to utilize the compressed gas efficiently by increasing the blast rate or the blast pressure in a case where the planar dimension of the area is large, or by decreasing the blast rate or the blast pressure in a case where the planar dimension of the area is small.

However, an operating principle of an image forming of the electrophotographic device is very complicated, and includes lots of variation factors. Thus, the amount of toner which is transferred onto the sheet is affected by the variation factors. Therefore, it is difficult to estimate increase and decrease amount of the toner transferred onto the sheet accurately based only on the image information. The sheet jam may occur in a case where adhesion of the sheet is increased by increased amount of toner transferred onto the sheet, even though the planar dimension of the area is relatively small. On the contrary, the sheet may be stripped stably and easily in a case where adhesion of the sheet is decreased by decreased amount of toner transferred onto the sheet, even though the planar dimension of the area is relatively large.

In order to solve the problems described above, it is necessary to set the blast rate or the blast pressure of the compressed gas all the time in a condition where the amount of the toner transferred onto the sheet becomes the maximum. However, this technique results in cost increase of the electrophotographic device and causes growth in size of a system including the electrophotographic device, since this technique requires large quantity of the compressed gas in order to increase capability of a compressed gas generating device. Further, this technique requires large amount of power for generating large quantity of the compressed gas, and results in increase of environmental load. Furthermore, this technique results in increase of heater power in order to counter cool down of the fixing roller performed by the increased compressed gas.

SUMMARY OF THE INVENTION

It is a general object of the present invention to provide an image forming apparatus which solves the problems described above, caused by the conventional image forming apparatus including the conventional heat fixing apparatus, and can strip the sheet from the fixing member with higher reliability in spite of a wide variety of conditions.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by an image forming apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides an image forming apparatus including: a fixing device including: a fixing member configured to be heated by a heater; and a pressure member configured to be pressed against the fixing member in order to form a nip portion between the fixing member and the pressure member, wherein a sheet configured to carry an unfixed toner image is fed into the nip portion in order to fix the unfixed toner image thereon; a compressor configured to supply compressed air; a nozzle configured to be disposed at an outlet side of the nip portion and to blast the compressed air supplied from the compressor to an adhered portion of the sheet to the fixing member; and a controller configured to correct open-time of the nozzle based on image forming condition and to control number of times that the compressed air is blasted to the sheet in accordance with length of corrected open-time, wherein the open-time of the nozzle is determined in accordance with basis weight of the sheet.

Other objects, features and advantages of the present invention will become more apparent from the following detailed description when read in conjunction with the accompanying drawings.

BRIEF DESCRIPTION OF THE DRAWINGS

FIG. 4 shows a table which includes relationships among basis weights of sheets, open-time T0 of an electromagnetic valve 35 and correction value;

FIG. 5 shows a table which includes relationships between print area ratio and correction value;

FIG. 6 shows a table which includes relationships between print density and correction value;

FIG. 7 shows a table which includes relationships between number of pages and correction value;

FIG. 8 shows a table which includes relationships between number of pages and correction value;

FIG. 9 shows a table which includes relationships among humidity and correction value;

FIG. 10 shows a table which includes relationships among temperature and correction value;

FIG. 11 shows a table which includes relationships among fixing preset temperature and correction value;

FIG. 12 shows a table which includes relationships among feeding speed and correction value;

FIG. 13 shows a table which includes relationships among amount of toner on a dummy image and correction value;

FIG. 14 shows a table which includes relationships among amount of toner consumed in developing device and correction value.

DESCRIPTION OF THE PREFERRED EMBODIMENTS

In the following, embodiments of the present invention will be described with reference to the accompanying drawings.

Figure 1:
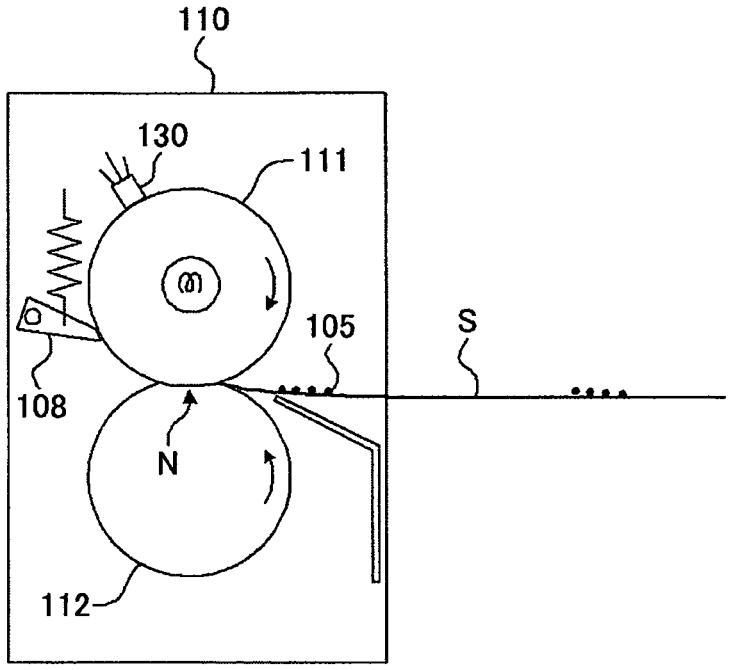
FIG. 1 shows a side view of an example of a conventional heat fixing apparatus.
Figure 2:
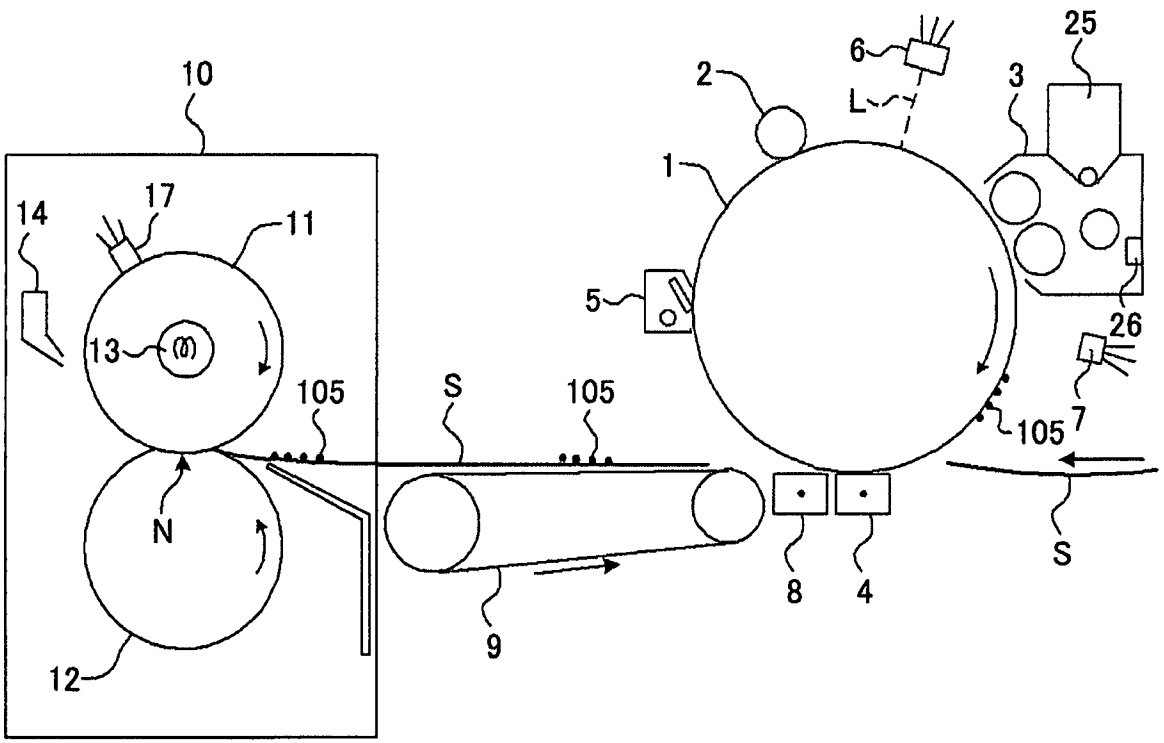
FIG. 2 is a schematic drawing showing an example of an image forming portion of an image forming apparatus according to the present embodiment.

FIG. 2 is a schematic drawing showing an example of an image forming portion of an image forming apparatus according to the present embodiment. The image forming apparatus according to the present embodiment includes a photoconductor drum 1 which constitutes an image carrying body. The image forming apparatus further includes a charge roller 2, a developing device 3, a transfer device 4, a cleaning device 5 or the like that are disposed around the photoconductor drum 1. An area between the charge roller 2 and the developing device 3 constitutes a writing area where a laser beam L is irradiated from a laser scanning device 6 onto the photoconductor drum 1. A toner sensor 7, which detects amount of toner transferred onto the surface of the photoconductor drum 1, is disposed adjacent to the surface and downstream side of the developing device 3 in a rotational direction of the photoconductor drum 1. The rotational direction of the photoconductor drum 1 is indicated by an arrow.

When the photoconductor drum 1 is rotated in the clockwise direction by a driving device which is not shown in FIG. 2, the surface of the photoconductor drum 1 is charged uniformly to a predetermined charge character by the charge roller 2. The laser beam L is irradiated from a laser scanning device 6 onto the charged surface of the photoconductor drum 1, and then an electrostatic latent image is formed on the surface of the photoconductor drum 1. The developing device 3 causes toner to transfer onto the electrostatic latent image which is rotated with the photoconductor drum 1. Herein, a toner concentration sensor 26 detects toner concentration in the developing device 3. When the toner concentration which is detected by the toner concentration sensor 26 draws to an end, a toner hopper 25 supplies a predetermined amount of toner into the developing device 3.

The sheet S is fed from a sheet feeder, which is not shown in FIG. 2, to the photoconductor drum 1 at an appropriate timing, and then the sheet S contacts with the photoconductor drum 1. A toner image 105 disposed on the surface of the photoconductor drum 1 is transferred onto the sheet S at the transfer device 4. The sheet S on which the toner image 105 is transferred is stripped from the photoconductor drum 1 by a stripping device 8. The sheet S stripped from the photoconductor drum 1 is conveyed to a fixing device 10 by a conveyor belt 9.

Figure 3:
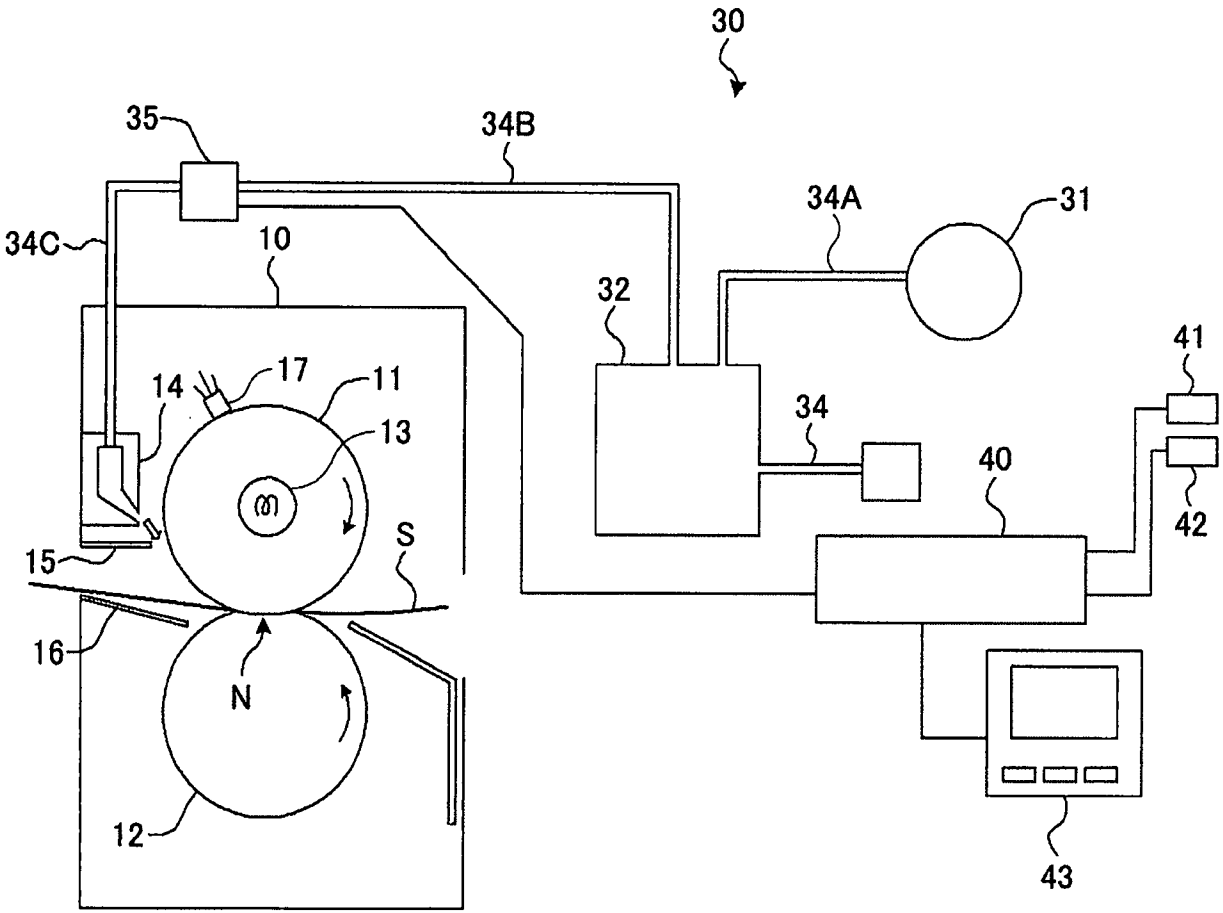
FIG. 3 is a schematic drawing showing configurations of a fixing device 10 and an air supplier.

FIG. 3 is a schematic drawing showing configurations of the fixing device 10 and an air supplier.

As shown in FIG. 3, the fixing device 10 includes a fixing roller 11 which constitutes a fixing member and a pressure roller 12 which constitutes a pressure member. The pressure roller 12 is pressed to the fixing roller 11 by a pressing device which is not shown in FIG. 3. A fixing heater 13 which constitutes a heater is disposed in the fixing roller 11. The fixing roller 11 is rotated in the clockwise direction by a driving device which is not shown in FIG. 3, and then the pressure roller 12 is driven by the fixing roller 11. The sheet S which carries an unfixed toner image 105 is nipped between the fixing roller 11 and the pressure roller 12 and is conveyed from right side to left side in FIG. 3. A fixing nip portion N is formed by pressing the pressure roller 12 against the fixing roller 11. The toner image 105 is fixed onto the sheet S by heat and pressure when the sheet S passes through the fixing nip portion N.

A nozzle 14 is disposed at the outlet side of the fixing nip portion N. The nozzle 14 blasts compressed air to the sheet S, which is output from the fixing nip portion N, in the direction shown by a thick arrow. The sheet S is wrapped around the fixing roller 11 by adhesion of adhered toner. When the compressed air is blasted from an opening of the nozzle 14 to the fore-end of the sheet S which is conveyed by the fixing roller 11, the sheet S is stripped from the fixing roller 11. When the fore-end of the sheet S is stripped from the fixing roller 11 in the outlet side of the fixing nip portion N, the sheet S is fed along an upper sheet guide 15 or a lower sheet guide 16.

A compressed air supplier 30 reserves the compressed air which is compressed by a compressor 31 in an air tank 32 which is connected to the compressor by a pipe 34A. The air tank 32 and the nozzle 14 of the fixing device 10 are connected via pipes 34B and 34C. An electromagnetic valve 35 is inserted between the pipe 34B and the pipe 34C. The electromagnetic valve 35 is closed in normal state and shuts off the compressed air reserved in the air tank 32 and the pipe 34B. When the fore-end of the sheet S reaches a predetermined position, the electromagnetic valve 35 opens only for a predetermined period of time, and then the compressed air is blasted from the nozzle 14 to the fore-end of the sheet S as described above.

Herein, reference numeral 40 indicates a printer controller. Sheet sensors 41 and 42 that detect position of the sheet S and a controller 43 are connected to the printer controller 40. Open-close movement of the electromagnetic valve 35 is controlled by the printer controller 40.

The image forming apparatus according to the present embodiment includes the nozzle 14 which is disposed at the outlet side of the fixing nip portion N. The nozzle 14 constitutes a compressed air blasting part. The printer controller 40 controls open-time and close-time and number of times of open-close movement with respect to each sheet in accordance with basis weight information of the sheet S. The basis weight information is input to the printer controller 40 via the controller 43 by an operator of the image forming apparatus in advance.

Herein, the printer controller 40 may control open-time and close-time and number of times of open-close movement with respect to each sheet in accordance with planar dimension information which is input from the controller 43. The planar dimension information indicates planar dimension of the image which is printed on the sheet S. In this case, the controller 43 obtains the planar dimension of the image based on image information and outputs the planar dimension information to the printer controller 40.

Herein, the printer controller 40 may control open-time and close-time and number of times of open-close movement with respect to each sheet in accordance with toner amount information which is input from the toner hopper 25. The toner amount information indicates amount of the toner which is supplied to the developing device 3 from the toner hopper 25. In this case, the toner hopper 25 determines the amount of toner based on toner concentration information which is input from the toner concentration sensor 26. The toner concentration 26 detects the toner concentration and outputs the toner concentration information which indicates the toner concentration.

Herein, the printer controller 40 may control open-time and close-time and number of times of open-close movement with respect to each sheet in accordance with print density information. The print density information is input to the printer controller 40 via the controller 43 by an operator of the image forming apparatus in advance.

Herein, the printer controller 40 may control open-time and close-time and number of times of open-close movement with respect to each sheet in accordance with developer expiration date information. The printer controller 40 counts the developer expiration date information which indicates the expiration date of the developer. The developer expiration date information constitutes time degradation information of the developer.

Herein, the printer controller 40 may control open-time and close-time and number of times of open-close movement with respect to each sheet in accordance with photoconductor expiration date information. The printer controller 40 counts the photoconductor expiration date information which indicates the expiration date of the photoconductor drum 1. The photoconductor expiration date information constitutes time degradation information of the photoconductor.

Herein, a dummy image may be formed on the photoconductor drum 1 and the printer controller 40 may control open-time and close-time and number of times of open-close movement with respect to each sheet in accordance with the amount of the toner on the dummy image. The amount of the toner on the dummy image is detected by the toner sensor 7.

Herein, the printer controller 40 may control open-time and close-time and number of times of open-close movement with respect to each sheet in accordance with humidity or temperature in or around the image forming apparatus. In this case, the humidity or the temperature is detected by a humidity sensor or a temperature sensor which is disposed in or around the image forming apparatus.

Herein, the printer controller 40 may control open-time and close-time and number of times of open-close movement with respect to each sheet in accordance with temperature controlling value which is used for controlling temperature of the fixing roller 11. The temperature controlling value constitutes fixing preset temperature.

Herein, the image forming apparatus may be able to vary the feeding speed of the sheet S and the printer controller 40 may control open-time and close-time and number of times of open-close movement with respect to each sheet in accordance with the feeding speed of the sheet S.

By the way, the electrophotographic device which adopts a compressed-air-type sheet stripping device processes with relatively high speed. In general, such an electrophotographic device requires an operator of the electrophotographic device to input basis weight of the sheet S in advance, in order to optimize temperature of a fixing roller, various conditions of an electrophotographic, various conditions of sheet feeding or the like.

Additionally, in general, the electrophotographic device requires an operator of the electrophotographic device to input print density in advance, so that the print density is optimized in accordance with use application of printed sheet or preference of people who use the printed sheet.

Further, in general, the electrophotographic device requires an operator of the electrophotographic device to input information of fixing temperature in advance, in order to optimize curl amount of the sheet S or fixing strength which is attributed by quality of the sheet S.

The electrophotographic device according to the present embodiment requires the operator to input information of basis weight of the sheet S, the print density or fixing temperature via the controller 43. The controller 43 constitutes an input panel. The information which is input via the controller 43 is transmitted to the printer controller 40 and stored therein. A general electrophotographic device includes plural sheet feeders each of which feeds the sheet S one by one from stacked sheets. In such a case, in order to use sheets of various basis weights, it is necessary to store the sheets into plural sheet feeders with respect to each basis weight.

The image forming apparatus according to the present embodiment estimates difficulty level of sheet stripping in accordance with preset value input by the operator and data stored in the controller 40, and optimizes blast rate of the compressed air which is blasted from the nozzle 14 by increasing or decreasing the blast rate. Hereinafter, controlling process of the blast rate will be described in detail.

FIG. 4 shows a table which includes relationships among the basis weights of the sheets, open-time T0 of the electromagnetic valve 35 and correction value.

The open-time T0 of the electromagnetic valve 35 varies in accordance with the basis weight of the sheet S. Herein, the basis weight of the sheet corresponds to thickness of the sheet. As the basis weight increases, the thickness of the sheet increases in general. Further, the basis weight of the sheet corresponds to rigidity of the sheet. The lighter the basis weight of the sheet becomes, i.e. the lower the rigidity of the sheet becomes, the weaker the restoring force of the sheet becomes. The restoring force acts on the sheet to blast from the fixing roller 11. Thus, the weaker the restoring force of the sheet becomes, the adhesion of the sheet to the fixing roller 11 becomes stronger. Thus, the open-time T0 is set to be longer with the lighter sheet. Herein, the sheet which has the basis weight more than 157 g/m$^2$ has sufficient rigidity and is stripped from the fixing roller 11, i.e. does not wrap around the fixing roller 11. Thus, the open-time T0 is set to 0 ms with the sheet which has basis weight more than 157 g/m$^2$ according to the present embodiment. It is not necessary to blast the compressed air to the sheet which has the basis weight more than 157 g/m$^2$. Although the sheet which has basis weight ranging from 86 to 156 g/m$^2$ may wrap around the fixing roller 11, the adhesion thereof is relatively weak. Thus, the open-time is set to 60 ms, with regard to the sheet which has basis weight ranging from 86 to 156 g/m$^2$.

The image forming apparatus calculates the open-time of the electromagnetic valve 35 by correcting the open-time T0 as shown in FIG. 4 in accordance with various conditions as described below. The open-time T0 as shown in FIG. 4 is used as the basis for calculating open-time T which is used for controlling the electromagnetic valve 35. According to the image forming apparatus of the present embodiment, it is not necessary to correct the open-time with regard to the sheet which has basis weight more than 86 g/m$^2$, since the adhesion thereof is sufficiently weak. Thus, the correction value with regard to the sheet which has basis weight more than 86 g/m$^2$ is set to 0 ms, and the open-time T thereof is set to the open-time T0.

With regard to a page printer, it is easy to calculate planar dimension of an area or areas on which the toner is to be transferred, since the page printer executes printing process by using image information which corresponds to each sheet. The area(s) on which the toner is to be transferred corresponds to area(s) on which the printing process is to be executed. Hereinafter, a ratio of the area(s) on which the printing process is to be executed to a whole area of the surface of the sheet is called as print area ratio.

As the amount of the toner transferred onto the sheet increases, the adhesion becomes larger. Thus, in order to strip the sheet from the fixing roller steadily and to blast the compressed air economically, it becomes necessary to increase the blast rate of the compressed air in accordance with the increase of the print area ratio. Thus, the image forming apparatus corrects the open-time T0 to open-time T1 by using a table data as shown in FIG. 5 in accordance with the print area ratio. The table data as shown in FIG. 5 includes correction value which is used for correcting the open-time T0 to the open-time T1. In a case where the print area ratio becomes lower than 15%, effects that will be described later become weaker. Thus, the correction of the open-time may not be necessary, and the correction value thereof may be set to 0 ms as shown in FIG. 5.

The image forming apparatus requires an operator to input print density, so that the print density is optimized in accordance with use application of printed sheet or preference of people who use the printed sheet. The image forming apparatus according to the present embodiment includes five levels of the print densitys of "thin", "thinnish", "normal", "thickish" and "thick". The image forming apparatus controls the print density by increasing or decreasing the amount of the toner which is transferred onto the electrostatic latent image formed on the photoconductor drum 1. The amount of the toner is increased/decreased by increasing/decreasing bias voltage which is applied to a developing roller disposed in the developing device 3 based on the five-level print density.

Since the amount of the toner transferred onto the electrostatic latent image varies in accordance with the level of the print density in the same image, the adhesion of the sheet and the fixing roller 11 varies. Thus, it becomes necessary to vary the blast rate of the compressed air in accordance with the level of the print density, in order to strip the sheet from the fixing roller steadily and to blast the compressed air economically. Accordingly, the image forming apparatus according to the present embodiment corrects the open-time T1 to open-time T2 by using a table data as shown in FIG. 6. The table data as shown in FIG. 6 includes correction value which is used to correct the open-time T1 to the open-time T2. In a case where the print density is set to "thin", effects that will be described later become weaker. Thus, the correction of the open-time may not be necessary, and the correction value thereof may be set to 0 ms as shown in FIG. 6.

The developing device 3 has a function of transferring the toner onto the electrostatic latent image which is formed onto the photoconductor drum 1 by contacting a charged toner to the photoconductor drum 1 or by bringing a charged toner close to the photoconductor drum 1. Since the charged toner is transferred onto the electrostatic latent image by electrostatic force, the amount of the toner transferred onto the electrostatic latent image formed on the photoconductor drum 1 is varied with respect to charge amount of the toner. There is a relationship between the charge amount of the toner and the amount of the toner transferred onto the electrostatic latent image. According to the relationship, in a case where the charge amount is smaller than a predetermined target amount, the amount of the toner transferred onto the electrostatic latent image becomes larger than a predetermined target amount.

Mixture of a carrier and the toner is stored in the developing device 3. The carrier may be fine iron powder, for example. The mixture is called developer. The developer is stirred by a screw or a roller, which includes a magnetic pole, disposed in the developing device 3. As a result, the toner is charged by friction caused by stirring.

Since the developer has the expiration date, the developer is replaced to a new one when number of printing times reaches to a predetermined times. It is well known that the charge amount of toner varies until the developer reaches the expiration date, even if the developer is stirred by the developing device 3 in the same way. When the developer is new, the charge amount of the toner is relatively low. As the number of printing times increases, the charge amount of the toner increases. Thus, the amount of toner transferred onto the sheet is relatively large when the developer is new, and gradually decreases as the number of printing times increases. Accordingly, the image forming apparatus according to the present embodiment corrects the open-time T2 to open-time T3 by using a table data as shown in FIG. 7. The table data as shown in FIG. 7 includes correction value which is used to correct the open-time T2 to the open-time T3 in accordance with the number of pages printed by the developer. The number of pages printed by the developer constitutes the time degradation information of the developer.

The photoconductor drum 1 is charged uniformly by the charge roller 2, and then the electrostatic latent image of which electrical potential is relatively low is depicted on the photoconductor drum 1 by a laser beam output from an LED or a laser beam oscillator. The charged toner is transferred only onto the electrostatic latent image of which electrical potential is relatively low, by using an photoconductive principle. The amount of the toner onto the electrostatic latent image varies in accordance with variation of electrical potential of the electrostatic latent image. The lower the electrical potential of the electrostatic latent image becomes, the larger the amount of the toner transferred onto the electrostatic latent image becomes.

Since, the photoconductor drum 1 has the expiration date, photoconductor drum 1 is replaced to a new one when number of printing times reaches to a predetermined times. It is well known that the electrical potential of electrostatic latent image varies until the photoconductor drum 1 comes to the expiration date, even if the photoconductor drum 1 is irradiated by the laser beam in the same way. When the developer is new, the electrical potential of the electrostatic latent image is relatively low. As the number of printing times increases, the electrical potential increases. Thus, the amount of toner transferred onto the sheet is relatively large when the photoconductor drum 1 is new, and gradually decreases as the number of printing times increases. Accordingly, the image forming apparatus according to the present embodiment corrects the open-time T3 to open-time T4 by using a table data as shown in FIG. 8. The table data as shown in FIG. 8 includes correction value which is used to correct the open-time T3 to the open-time T4 in accordance with the number of pages printed by the photoconductor drum 1. The number of pages printed by the photoconductor drum 1 constitutes the time degradation information of the developer.

Electrophotographic printing process is affected by temperature and humidity. It is well known that amount of toner becomes larger, as temperature or humidity becomes higher. Accordingly, the image forming apparatus according to the present embodiment corrects the open-time T4 to open-time T5 by using a table data as shown in FIG. 9. The table data as shown in FIG. 9 includes correction value which is used to correct the open-time T4 to the open-time T5 in accordance with humidity. Further, the image forming apparatus according to the present embodiment corrects the open-time T4 to open-time T6 by using a table data as shown in FIG. 10. The table data as shown in FIG. 10 includes correction value which is used to correct the open-time T4 to the open-time T6 in accordance with temperature.

The toner which is transferred onto the sheet is fused by heat of the fixing roller 11 and then fixed to the sheet. Since there are various kinds of sheets, the fixing strength of the sheet may be affected by variety of the sheet. The image forming apparatus requires an operator to input temperature of the fixing roller 11 in advance, so that the fixing strength is optimized. Information of the temperature of the fixing roller 11 input by the operator is stored as the fixing preset temperature in the image forming apparatus. The image forming apparatus according to the present embodiment includes three levels of the temperatures of "low", "normal" and "high". The curl amount of the sheet may be affected by the fixing roller. The curl of the sheet may occur after the toner is fixed to the sheet. In a case where the curl amount of the sheet is relatively large and problem may be caused by the curl, it may be possible to reduce the curl amount of the sheet by setting the level of the temperature to "low". The image forming apparatus according to the present embodiment controls the temperature of the fixing roller 11 based on the temperature of the fixing roller 11 input by the operator.

Viscosity of the fused toner is affected by temperature of the toner. The viscosity becomes lower as the temperature becomes higher, and the viscosity becomes higher as the temperature becomes lower. In a case where the temperature of the fixing roller 11 is set to "low", the adhesion of the sheet to the fixing roller 11 becomes larger and it becomes uneasy to strip the sheet from the fixing roller 11.

Accordingly, the image forming apparatus according to the present embodiment corrects the open-time T6 to open-time T7 by using a table data as shown in FIG. 11. The table data as shown in FIG. 11 includes correction value which is used to correct the open-time T6 to the open-time T7 in accordance with the temperature of the fixing roller 11 input by the operator, i.e. the fixing preset temperature.

Image density, tone level, the fixing strength or the like are affected by the basis weight or variety of the sheet. The variety of the sheet includes, for example, existence or non-existence of a surface coat of the sheet or the like. It is well known to vary the feeding speed of the sheet in order to optimize the image density, the tone level, the fixing strength or the like.

The compressed air is blasted to the sheet which is output from the fixing nip portion N. As the feeding speed becomes slower, length of the sheet, in the direction of feed direction of the sheet, in which the compressed air is blasted becomes shorter in the same blasting time. Thus, as the feeding speed becomes slower, the length of the sheet in which the compressed air is blasted becomes shorter and it becomes more difficult to strip the sheet from the fixing roller 11. Accordingly, the image forming apparatus according to the present embodiment corrects the open-time T7 to open-time T8 by using a table data as shown in FIG. 12. The table data as shown in FIG. 12 includes correction value which is used to correct the open-time T7 to the open-time T8 in accordance with the feeding time of the sheet. The feeding time is in inverse proportion to the feeding speed.

It is well known technique to form a dummy latent image in a position, where transfer of the image to the sheet is not processed, on the surface of the photoconductor drum 1. The dummy latent image constitutes a reference patch, and becomes the dummy image after being developed by the developing device 3. According to the technique, the amount of the toner which is transferred onto the photoconductor drum 1 is detected by a sensor which detects the amount of the toner which is transferred onto the dummy image. According to this technique, it becomes possible to detect the amount of the toner transferred onto the photoconductor drum 1 directly and more accurately than the image forming apparatus which estimates the amount of the toner transferred onto the photoconductor drum 1. The image forming apparatus according to the present embodiment may correct the open-time T1 to open-time T9 by using a table as shown in FIG. 13 instead of using the tables as shown in FIGS. 6, 7, 8, 9 and 10. FIG. 13 includes relationships between the amount of the toner transferred onto the dummy image and correction value of the open-time which corrects the open-time T1 to T9. The amount of the toner which is transferred onto the dummy image can be detected by the toner sensor 7 (shown in FIG. 2) that is disposed adjacent to the developing device 3 in the downstream side in the rotational direction of the photoconductor drum 1. The image forming apparatus according to the present embodiment can correct the open-time of the electromagnetic valve 35 based on the amount of the toner, which is transferred onto the dummy image and detected by the toner sensor 7, by using the correction value as shown in FIG. 13.

The toner which is contained in the developer stored in the developing device 3 is consumed during the printing process. The toner concentration sensor 26 detects the toner concentration of the toner contained in the developer. When the toner concentration which is detected by the toner concentration sensor 26 becomes less than a predetermined level, the toner hopper 25 supplies a predetermined amount of toner to the developing device 3. Thus, the amount of the toner in the developing device is kept to a certain level. Accordingly, it becomes possible to calculate the amount of the toner transferred onto the sheet roughly, by detecting the amount of the toner supplied from the toner hopper 25 to the developing device in a unit of time. The image forming apparatus according to the present embodiment may set the open-time T0 of the electromagnetic valve 35 by using a table as shown in FIG. 14. Further, the image forming apparatus according to the present embodiment may correct the open-time T0 by using the tables as shown in FIGS. 5, 11, 12 and 13 instead of using the tables as shown in FIGS. 6, 7, 8, 9 and 10. FIG. 14 includes relationships between the amount of the toner consumed in the developing device and the open-time T0 of the electromagnetic valve 35.

Figure 15:
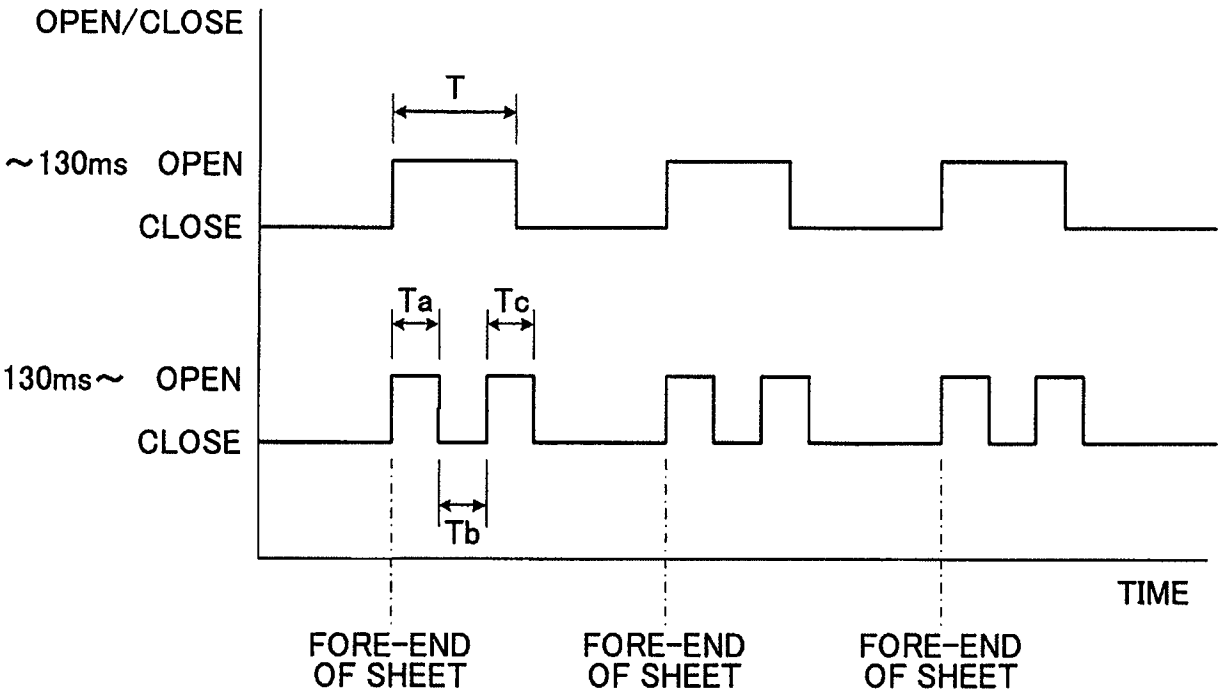
FIG. 15 shows a timing chart for controlling the electromagnetic valve 35.

FIG. 15 shows a timing chart for controlling the electromagnetic valve 35. As shown in FIG. 15, the image forming apparatus according to the present embodiment strip the sheet from the fixing roller 11 by opening the electromagnetic valve 35 with respect to each fore-end of the sheet and blasting the compressed air from the nozzle 14. The compressor 31 is in operation even when the electromagnetic valve 35 is closed, thus the compressed air is reserved into the air tank 32. If the close-time of the electromagnetic valve 35 is sufficiently longer than the open-time, pressure of the compressed air in the air tank 32 does not decrease even though the blasting capability of the compressor 31 is relatively small.

For example, in a condition where the feeding speed of the sheet is 700 mm/s, the capacity of the air tank 32 is 1300 cc, the pressure of the compressed air is 0.1 MPa, the opening space of an exhaust nozzle 14 is 3 $mm^2$, the number of the opening is one and the printing speed is 150 sheets per minute, it is known that the blasting capability of the compressor 31 of 12.5 L/min is sufficient where the open-time is 90 ms. Since the blasting capability of the compressor 31 is constant, the pressure of the compressed air reduces, as the open-time increases. For example, the pressure of the compressed air reduces by 0.04 MPa, when the open-time is lengthened by 80 ms. It is experimentally known that a reduction of the pressure of the compressed air affects the stripping capability of the sheet.

Accumulation of the correction values is increased up to 80 ms at the maximum by accumulating the correction values included in FIGS. 5 to 14. The pressure of the compressed air may be reduced by the increase of the open-time. Thus, an effect obtained by the increase of the open-time may be reversed with a reduction of the pressure. The image forming apparatus according to the present embodiment can keep the effect of stripping the sheet and suppress reduction of the pressure by reducing the blast rate. The reduction of the blast rate is achieved by interposing a close-time into the open-time T, as shown in FIG. 15, in a case where the accumulation of the correction values exceeds 40 ms and the open-time exceeds 130 ms.

For example, in a case where the open-time becomes 130 ms, the image forming apparatus according to the present embodiment sets first open-time Ta at 50 ms, second open-time Tc at 50 ms and close-time Tb at 30 ms, respectively. In a case where the open-time becomes 150 ms, the image forming apparatus according to the present embodiment sets the first open-time Ta at 60 ms, the second open-time Tc at 60 ms and the close-time Tb at 50 ms, respectively. Herein, the open-time T is divided into the first open-time Ta and the second open-time Tc by interposing the close-time Tb into the open-time T.

The image forming apparatus according to the present embodiment may utilize historical data of the open-time. For example, the image forming apparatus according to the present embodiment may not interpose the close-time into the open-time if there is no sheet of which the open-time exceeds 130 ms among the last ten sheets, in a case where the accumulation of the correction values exceeds 40 ms and the open-time exceeds 130 ms. Further, the image forming apparatus according to the present embodiment may set the Ta at 45 ms, the Tc at 45 ms and the Tb at 40 ms, respectively, if there is less than five sheets of which the open-time exceed 130 ms among the last ten sheets. The control described above is effective in suppressing reduction of the pressure of the compressed air.

According to the image forming apparatus as described above, it becomes possible to strip the sheet from the fixing roller 11 in accordance with the condition of the open-time of the electromagnetic valve 35. The image forming apparatus as described above can set the open-time in accordance with variety of the adhesion of the sheet to the fixing roller 11 in a case where the adhesion is varied by variety of the sheet or the condition of the image forming apparatus or the like. Thus, it becomes possible to minimize the blasting capability of the compressor 31. Accordingly, it becomes possible to provide a cheap, small, environmentally friendly electrophotographic image forming device which can suppress the sheet jam.

Herein, the size of the opening space of the nozzle 14 which blasts the compressed air is affected by the number of the nozzle, the pressure of the compressed air or the like. It is appropriate to set the opening space of the nozzle 14 of the compressed air from 0.5 $mm^2$ to 8 $mm^2$, in a case where the number of the nozzle 14 is one. The open-time of the electromagnetic valve 35 is affected by the blasting capability of the compressor 31, the opening space of the nozzle 14 or the like. It is appropriate to set the open-time from 30 ms to 250 ms. Further, the number of the nozzle 14 is affected by the width of the largest sheet which can be printed by the image forming apparatus. It is appropriate to set the number of the nozzle 14 from one to ten in the direction of the axis of the fixing roller 11.

The present invention is not limited to the embodiments as described above. For example, the fixing member may not be limited to a roller, a fixing belt may be used as the fixing member. Similarly, a pressure belt may be used as the pressure member. A heater may be included in the pressure roller. An external heater for heating the fixing member may be used instead of the fixing heater 13. An induction heater for heating the fixing member may be used instead of the fixing heater 13. Further, a stripping plate which assists stripping process of the sheet from the fixing roller 11 may be used additionally.

Herein, the configuration of the image forming portion of the image forming apparatus may be varied arbitrary. For example, the present invention may be applied to not only monochrome image forming apparatus but also color image forming apparatus. Further, the image forming apparatus of the present invention can be applied to a printing machine, a copier, a facsimile machine, and a complex machine of a printing machine, a facsimile machine, and a copier etc.

The present invention is not limited to the specifically disclosed embodiments, and variations and modifications may be made without departing from the scope of the present invention.

The present application is based on Japanese priority application No. 2010-041953 filed on Feb. 26, 2010 with the Japanese Patent Office, the entire contents of which are hereby incorporated herein by reference.

What is claimed is:

1. An image forming apparatus, comprising:

a fixing device including:

a fixing member configured to be heated by a heater; and a pressure member configured to be pressed against the fixing member in order to form a nip portion between the fixing member and the pressure member, wherein a sheet configured to carry an unfixed toner image is fed into the nip portion in order to fix the unfixed toner image thereon;

a compressor configured to supply compressed air;

a nozzle configured to be disposed at an outlet side of the nip portion and to blast the compressed air supplied from the compressor to an adhered portion of the sheet to the fixing member;

an electromagnetic valve for opening and closing the supplied compressed air to the nozzle; and a controller configured to correct open-time of the nozzle based on image forming condition and to control number of times that the compressed air is blasted to the sheet in accordance with length of corrected open-time, wherein the open-time of the nozzle is determined in accordance with basis weight of the sheet, wherein the open-close movement of the electromagnetic valve is controlled by the controller.

2. The image forming apparatus as claimed in claim 1, wherein the image forming condition is print area ratio.

3. The image forming apparatus as claimed in claim 1, wherein the image forming condition is print density.

4. The image forming apparatus as claimed in claim 1, wherein the image forming condition is time degradation of developer.

5. The image forming apparatus as claimed in claim 1, wherein the image forming condition is time degradation of an image carrying body.

6. The image forming apparatus as claimed in claim 1, wherein the image forming condition is humidity.

7. The image forming apparatus as claimed in claim 1, wherein the image forming condition is temperature.

8. The image forming apparatus as claimed in claim 1, wherein the image forming condition is fixing preset temperature.

9. The image forming apparatus as claimed in claim 1, wherein feeding speed of the sheet fed by the fixing device is variable and the image forming condition is the feeding speed.

10. The image forming apparatus as claimed in claim 1, wherein the image forming condition is amount of toner transferred onto a reference image formed on an image carrying body.

11. The image forming apparatus as claimed in claim 1, further comprising a toner concentration detector configured to detect toner concentration in a developing device, and wherein the image forming condition is the toner concentration detected by the toner concentration detector.

12. The image forming apparatus as claimed in claim 1, further comprising an air tank to reserve the compressed air generated by the compressor.

13. The image forming apparatus as claimed in claim 12, wherein the electromagnetic valve is closed in normal state and shuts off the compressed air reserved in the air tank.

14. The image forming apparatus as claimed in claim 13, wherein the electromagnetic valve opens for a set period of time when an end of the sheet reaches a set position.

15. The image forming apparatus as claimed in claim 1, wherein the controller controls open-time and close-time and number of times of open-close movement with respect to each sheet in accordance with planar dimension information.

16. The image forming apparatus as claimed in claim 1, wherein the controller controls open-time and close-time and number of times of open-close movement with respect to each sheet in accordance with toner amount information which is input from a toner hopper.

17. The image forming apparatus as claimed in claim 1, wherein the controller controls open-time and close-time and number of times of open-close movement with respect to each sheet in accordance with density information.

18. The image forming apparatus as claimed in claim 1, wherein the controller controls open-time and close-time and number of times of open-close movement with respect to each sheet in accordance with developer expiration date information.

19. The image forming apparatus as claimed in claim 1, wherein the controller controls open-time and close-time and number of times of open-close movement with respect to each sheet in accordance with photoconductor expiration date information.

20. The image forming apparatus as claimed in claim 1, wherein the controller controls open-time and close-time and number of times of open-close movement with respect to each sheet in accordance with temperature controlling value which is used for controlling temperature of the fixing member.

21. The image forming apparatus as claimed in claim 15, wherein the controller controls the open-time and close-time and number of times of open-close movement so that the pressure of the compressed air is maintained at a substantially constant level in a case where an accumulation of correction values exceeds a designated period of time.

* * * * *